US008337153B2

(12) United States Patent
Orosa

(10) Patent No.: US 8,337,153 B2
(45) Date of Patent: Dec. 25, 2012

(54) TURBINE EXHAUST DIFFUSER FLOW PATH WITH REGION OF REDUCED TOTAL FLOW AREA

(75) Inventor: John A. Orosa, Palm Beach Gardens, FL (US)

(73) Assignee: Siemens Energy, Inc., Orlando, FL (US)

( * ) Notice: Subject to any disclaimer, the term of this patent is extended or adjusted under 35 U.S.C. 154(b) by 811 days.

(21) Appl. No.: 12/476,302

(22) Filed: Jun. 2, 2009

(65) Prior Publication Data

US 2010/0303607 A1 Dec. 2, 2010

(51) Int. Cl.
*F01D 25/24* (2006.01)

(52) U.S. Cl. ..... 415/182.1; 415/914

(58) Field of Classification Search ..... 415/211.2, 415/210.1, 914, 182.1, 224.5; 60/770, 771
See application file for complete search history.

(56) References Cited

U.S. PATENT DOCUMENTS

| | | | |
|---|---|---|---|
| 2,625,794 | A | 1/1953 | Williams et al. |
| 2,809,491 | A | 10/1957 | Wosika |
| 3,062,006 | A | 11/1962 | Egbert et al. |
| 3,241,316 | A | 3/1966 | Endres |
| 3,374,631 | A | 3/1968 | Marks |
| 3,625,630 | A | 12/1971 | Soo |
| 5,462,088 | A | 10/1995 | Poux et al. |
| 5,778,658 | A | 7/1998 | Lamando, Jr. et al. |
| 6,488,470 | B1 | 12/2002 | Owczarek |
| 6,733,238 | B2 | 5/2004 | Hiyama et al. |
| 7,272,930 | B2 | 9/2007 | Wiebe et al. |
| 7,373,773 | B2 | 5/2008 | Noda |
| 2003/0136102 | A1 | 7/2003 | Nottin |
| 2005/0050898 | A1 | 3/2005 | Noda |
| 2005/0066647 | A1 | 3/2005 | Wiebe et al. |
| 2009/0056340 | A1 | 3/2009 | Woltmann et al. |

FOREIGN PATENT DOCUMENTS

| | | | |
|---|---|---|---|
| GB | 2415749 | A | 1/2006 |
| JP | 2007303324 | A | 11/2007 |
| WO | 2007019336 | A2 | 2/2007 |

*Primary Examiner* — Dwayne J White

(57) ABSTRACT

An exhaust diffuser system and method for a turbine engine includes an inner boundary and an outer boundary with a flow path defined therebetween. The inner boundary is defined at least in part by a hub that has an upstream end and a downstream end. The outer boundary has a region in which the outer boundary extends radially inward toward the hub. The region can begin at a point that is substantially aligned with the downstream end of the hub or, alternatively, at a point that is proximately upstream of the downstream end of the hub. The region directs at least a portion of an exhaust flow in the diffuser toward the hub. As a result, the exhaust diffuser system and method can achieve the performance of a long hub system while enjoying the costs of a short hub system.

20 Claims, 4 Drawing Sheets

TURBINE EXHAUST DIFFUSER FLOW PATH WITH REGION OF REDUCED TOTAL FLOW AREA

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

The invention relates in general to turbine engines and, more particularly, to exhaust diffusers for turbine engines.

BACKGROUND OF THE INVENTION

Referring to FIG. 1, a turbine engine 10 generally includes a compressor section 12, a combustor section 14, a turbine section 16 and an exhaust section 18. In operation, the compressor section 12 can induct ambient air and can compress it. The compressed air from the compressor section 12 can enter one or more combustors 20 in the combustor section 14. The compressed air can be mixed with the fuel, and the air-fuel mixture can be burned in the combustors 20 to form a hot working gas. The hot gas can be routed to the turbine section 16 where it is expanded through alternating rows of stationary airfoils and rotating airfoils and used to generate power that can drive a rotor 26. The expanded gas exiting the turbine section 16 can be exhausted from the engine 10 via the exhaust section 18.

The exhaust section 18 can be configured as a diffuser 28, which can be a divergent duct formed between an outer shell 30 and a center body or hub 32 and a tail cone 34. The exhaust diffuser 28 can serve to reduce the speed of the exhaust flow and to increase the pressure of the exhaust gas coming from the last stage of the turbine. In some prior turbine exhaust sections, exhaust diffusion has been achieved by progressively increasing the cross-sectional area of the exhaust duct in the fluid flow direction, thereby expanding the fluid flowing therein.

It is preferable to minimize disturbances in the exhaust diffuser fluid flow; otherwise, the performance of the diffuser 28 can be adversely affected. Such disturbances in the fluid flow can arise for various reasons, including, for example, boundary layer separation. If fluid flow proximate a diffuser wall (the boundary layer) separates from the wall, there is a loss in the diffusing area and pressure recovery is reduced. Generally, the larger the angle of divergence in a diffuser, the greater the likelihood that flow separation will occur.

One approach to minimizing flow separation is to provide a diffuser with a relatively long hub. A long hub can maximize performance by delaying the dump losses—flow losses that occur at the downstream end of the hub/tail cone—to a point when the exhaust gases are traveling at a lower velocity, thereby minimizing wakes in the flow. However, a long hub presents a disadvantage in that it can make the engine design more complicated and expensive. For instance, a longer hub typically requires two rows of support struts 36—one in an upstream region of the hub 32 and one in a downstream region of the hub 32, as shown in FIG. 1. These support struts 36 can increase cost and the risk of material cracking due to thermal mismatch between inner and outer flowpath parts or vibratory loads. Further, long hubs can pose challenges in instances where available space is limited.

Another approach to minimizing flow separation losses is to provide a diffuser with a relatively short hub length followed by a reduced divergence angle. This approach can minimize cost by, among other things, requiring only a single row of support struts. However, diffuser performance may suffer because this design can often lead to high dump losses from having the hub end (sudden expansion) sooner where the flow velocities are higher. To avoid a second set of struts, associated tail cones are often steep, causing wakes to form in the flow downstream of the tail cone that continue to grow downstream.

Thus, there is a need for an exhaust diffuser that can achieve the performance benefits of a long hub design while enjoying the reduced cost and risk of a short hub design.

SUMMARY OF THE INVENTION

In one respect, embodiments of the invention are directed to an exhaust diffuser for a turbine engine. The exhaust diffuser includes an inner boundary defined at least by a hub, which has an upstream end and a downstream end. The exhaust diffuser also includes an outer boundary defined by a diffuser shell. The outer boundary is radially spaced from the inner boundary so that a flow path is defined between the inner and outer boundaries. The outer boundary has a region in which the outer boundary extends radially inward toward the inner boundary. The region begins at a point that is substantially aligned with or proximately upstream of the downstream end of the hub. As a result, the outer boundary directs at least a portion of an exhaust flow in the diffuser toward the hub.

The hub can have an associated axial length from the upstream end to the downstream end and an associated radius. The axial length of the hub can be about 2.2 to about 2.4 times the hub radius. The diffuser shell can have an associated axial length from an upstream end to a downstream end. The axial length of the hub can be from about 10 percent to about 12 percent of axial length of the diffuser shell.

In one embodiment, the exhaust diffuser can further include a tail cone having an upstream end and a downstream end. The upstream end of the tail cone can be attached to the downstream end of the hub. The inner boundary can also defined by the tail cone. The tail cone can have an associated axial length, and the hub can have an associated radius and an associated axial length. The axial length of the tail cone can be from about 1 to about 2 times the radius of the hub. The axial length of the tail cone can be from about 70 to about 85 percent of the axial length of the hub. The flow path can have an associated total flow area that varies along the length of the exhaust diffuser. The total flow area can decrease in the area of the tail cone. The total flow area of the flow path can increase immediately downstream of the tail cone.

The region can have a radially innermost point. The radially innermost point can be substantially aligned with the downstream end of the tail cone. Alternatively, the radially innermost point can be proximately upstream of the downstream end of the tail cone.

The region can have a beginning point at an associated first diameter. The region can have a radially innermost point at an associated second diameter. The second diameter can be from about 80 to about 90 percent of the first diameter, representing a reduction in diameter of about 10 to about 20 percent of the first diameter.

The region can have a radially innermost point having an associated first diameter. The outer boundary can have an inlet at an associated second diameter. The first diameter can be substantially equal to the second diameter.

The region can have a radially innermost point with an associated first diameter. The outer boundary can have an inlet at an associated second diameter. The first diameter can be less than the second diameter.

The region can have an associated axial length, and the hub can have an associated diameter. The axial length of the region can be from about 2 to about 3 times the diameter of the hub.

The flow path can have an associated total flow area that varies along the length of the exhaust diffuser. The total flow area can decrease in the area of the downstream end of the hub. The exhaust diffuser can have an associated axis. The outer boundary can extend at an angle relative to the axis immediately downstream of the region so as to form a diverging region. The outer boundary can have an initial diverging region transitioning into the radially inwardly extending region. In one embodiment, the hub can be supported by only a single row of support struts.

In another respect, embodiments of the invention are directed to a method of exhaust diffusion in a turbine engine. A turbine engine having a turbine section and an exhaust diffuser section is provided. The exhaust diffuser section includes an inner boundary defined at least by a hub. The hub has an upstream end and a downstream end. The exhaust diffuser section further includes an outer boundary that is radially spaced from the inner boundary so that a flow path is defined between the inner and outer boundaries. According to the method, turbine exhaust gas flow is supplied to the flow passage. At least a portion of the exhaust flow is directed toward the downstream end of the hub or proximately upstream of the downstream end of the hub. Such directing of the exhaust flow can be performed by the outer boundary in a region in which the outer boundary extends radially inward toward the inner boundary.

DETAILED DESCRIPTION OF THE INVENTION

Figure 3:
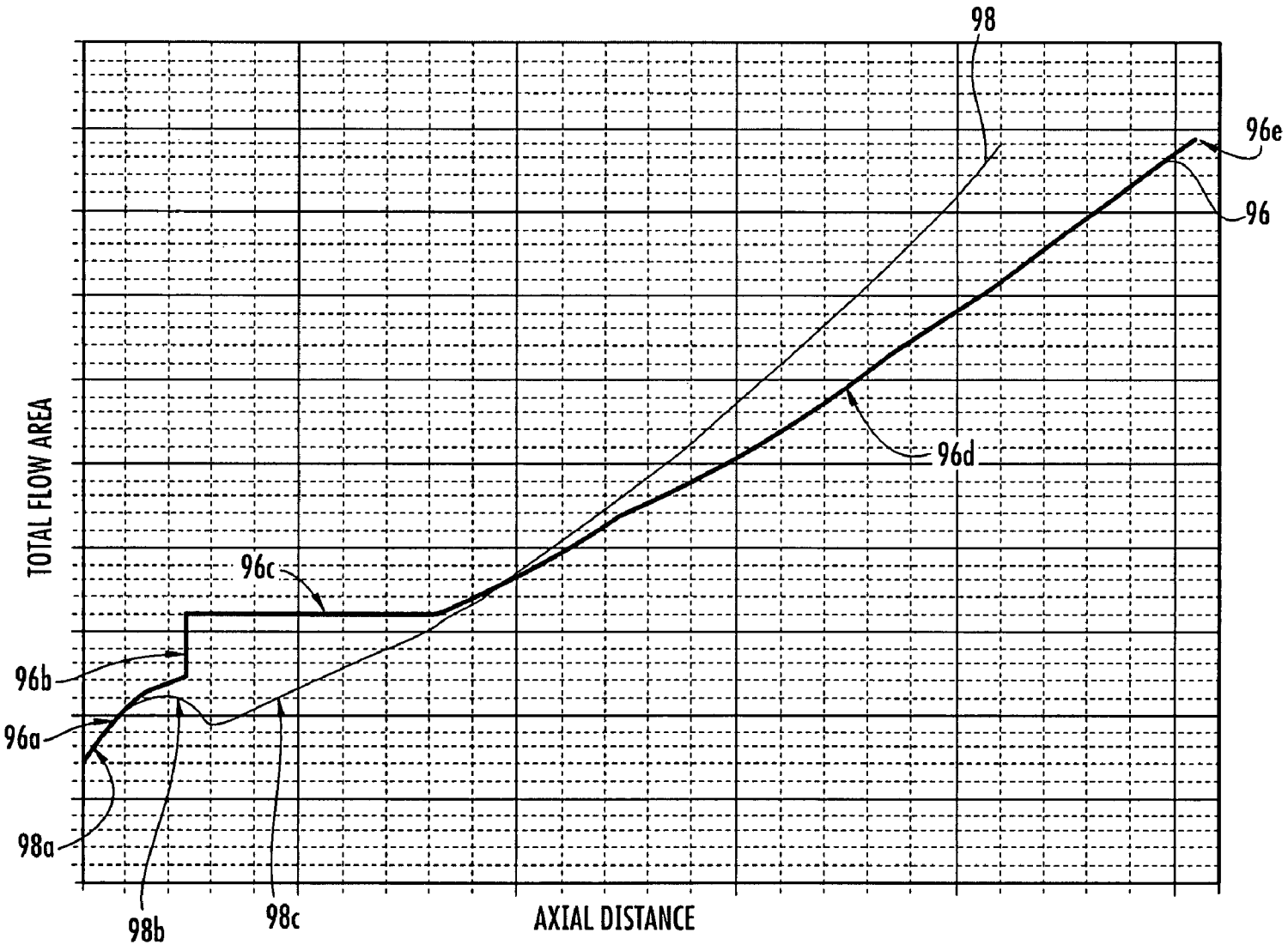
FIG. 3 is a graph showing the variation in the total flow area of an exhaust diffuser flow path along the axial length of an exhaust diffuser section, comparing one embodiment of an exhaust diffuser section configured in accordance with aspects of the invention to a known exhaust diffuser section.
Figure 4:
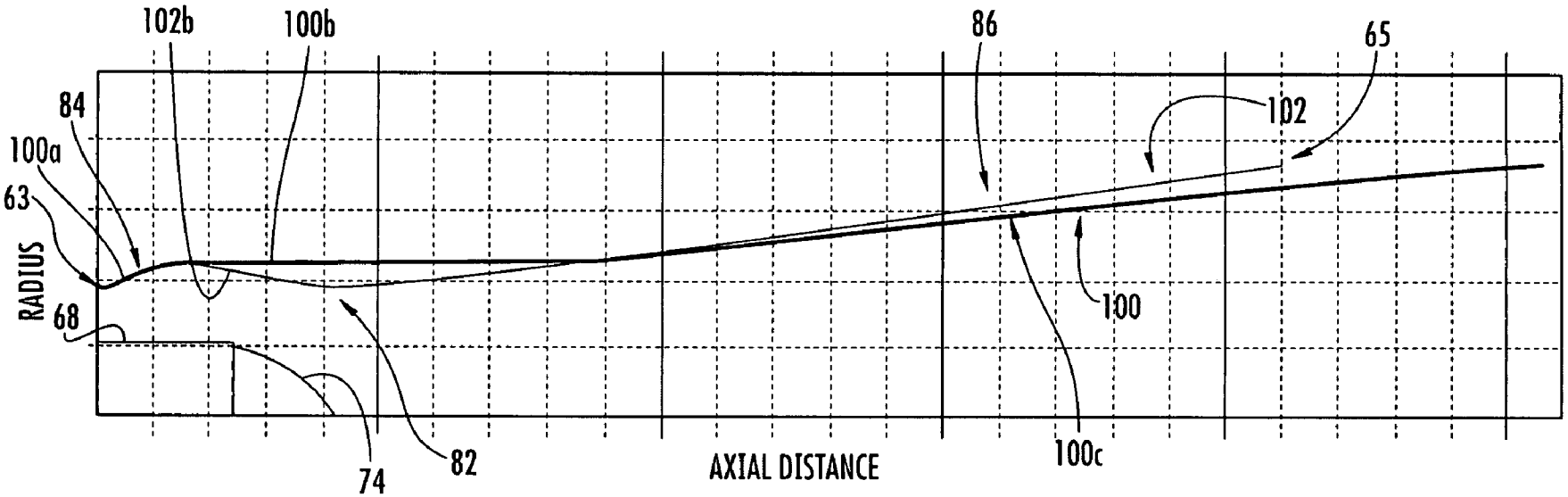
FIG. 4 is a graph of the profile of an inner boundary and an outer boundary of an exhaust diffuser flow path along the axial length of an exhaust diffuser section, comparing one embodiment of the outer boundary profile of an exhaust diffuser section configured in accordance with aspects of the invention to the outer boundary profile of a known exhaust diffuser section.

Embodiments of the invention are directed to an exhaust diffuser system, which can increase the power and efficiency of a turbine engine. Aspects of the invention will be explained in connection with various possible configurations, but the detailed description is intended only as exemplary. Embodiments of the invention are shown in FIGS. 2-4, but the present invention is not limited to the illustrated structure or application.

Figure 1:
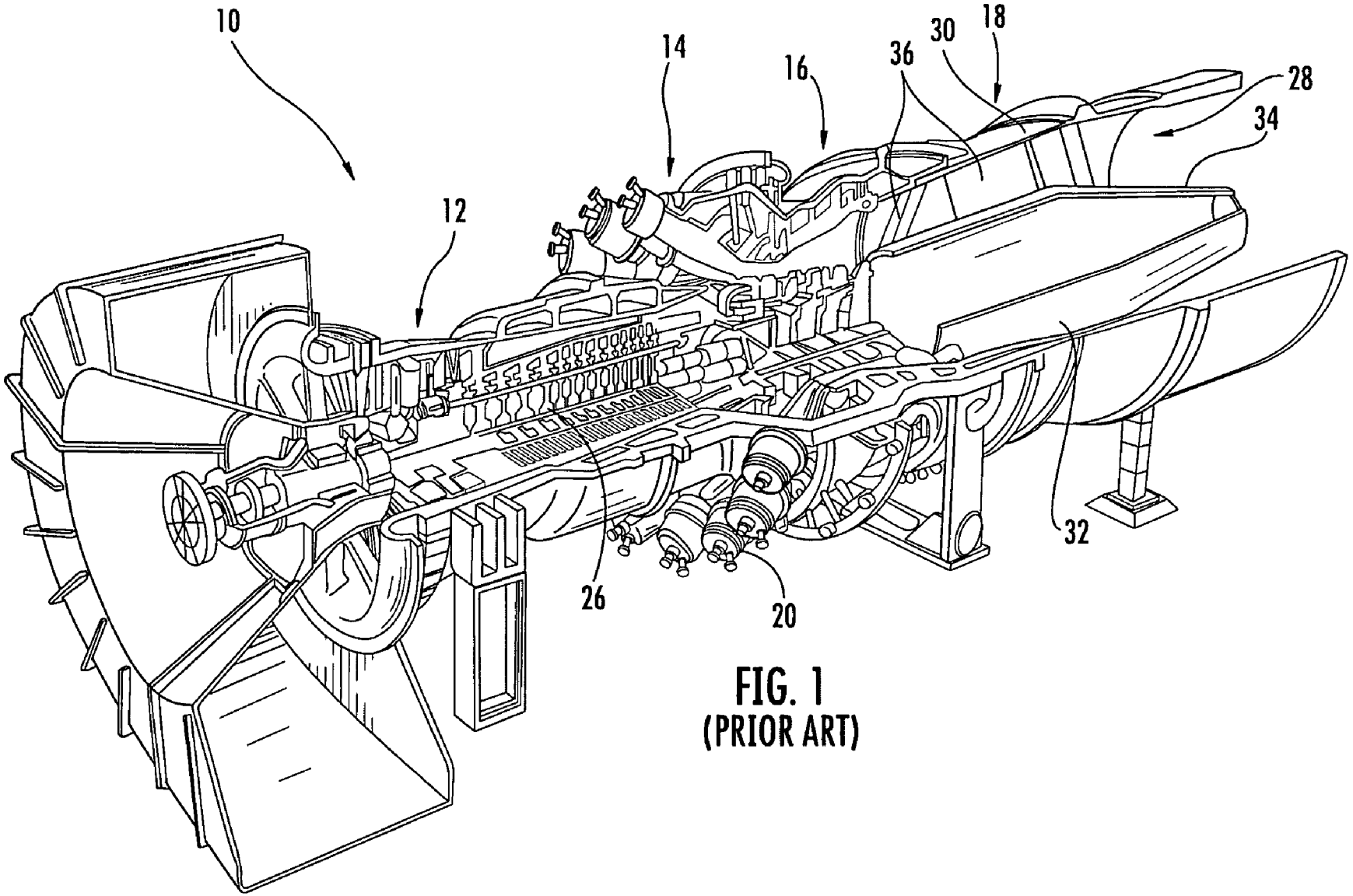
FIG. 1 (PRIOR ART)
FIG. 1 is a perspective view partially in cross-section of a known turbine engine.
Figure 2:
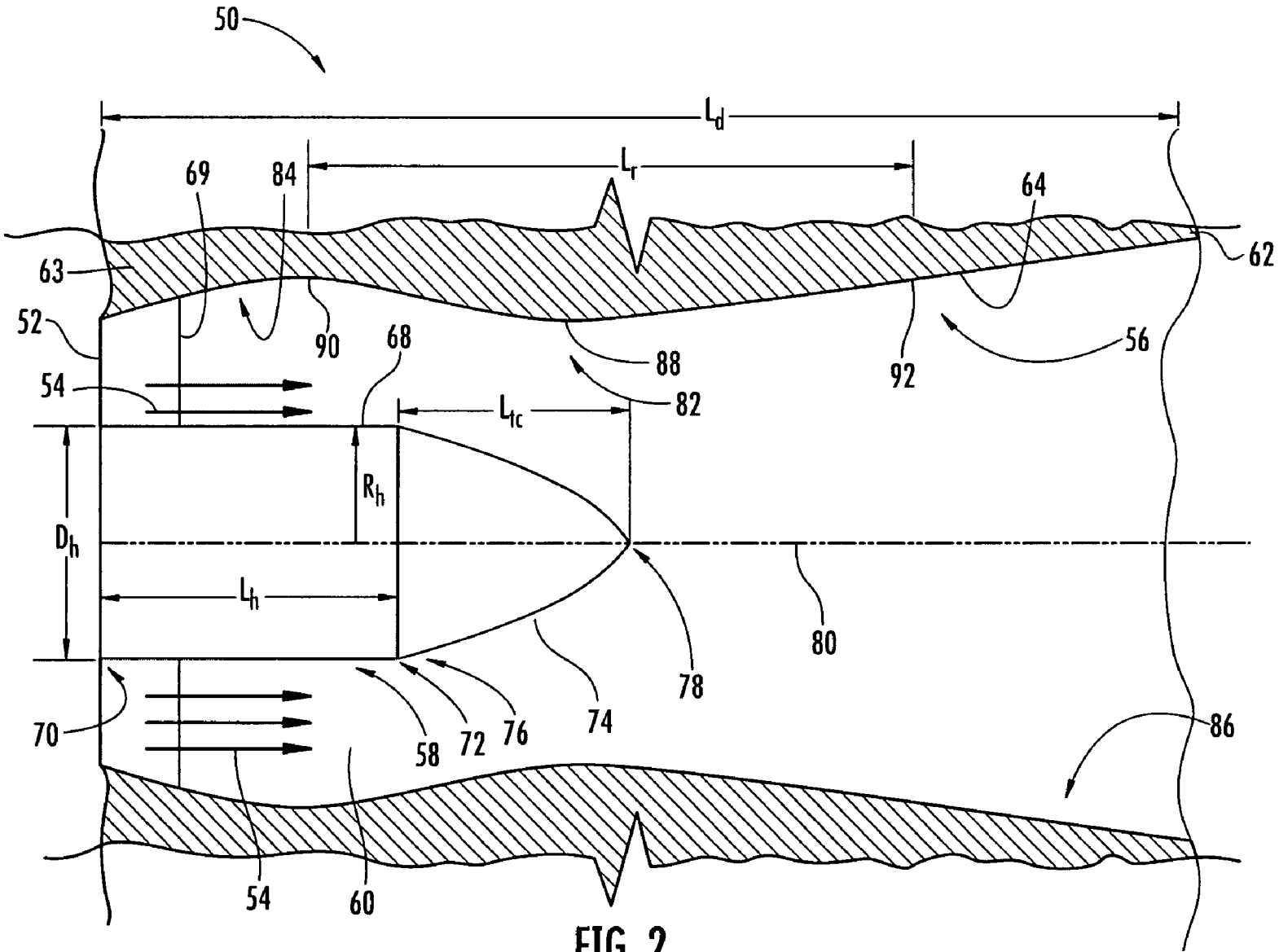
FIG. 2 is a side elevation cross-sectional view of an exhaust diffuser section of a turbine engine configured in accordance with aspects of the invention.

FIG. 2 shows a portion of the exhaust diffuser section 50 of a turbine engine configured in accordance with aspects of the invention. The exhaust diffuser section 50 is downstream of and in fluid communication with the turbine section (not shown) of the engine. The exhaust diffuser 50 has an inlet 52 that can receive gases 54 exiting from the turbine section. The exhaust diffuser section 50 can include an outer boundary 56 and an inner boundary 58. The outer boundary 56 is radially spaced from the inner boundary 58 such that a flow path 60 is defined between the inner and outer boundaries 56, 58. The flow path 60 can be generally annular or can have other suitable conformation. At least a portion of the flow path 60 can be generally conical.

The outer boundary 56 can be defined by a diffuser shell 62. The diffuser shell 62 can include an inner peripheral surface 64. The inner peripheral surface 64 can define the outer boundary 56 of the flow path 60. The diffuser shell 62 can define the axial length $L_d$ (only a portion of which is shown in FIG. 2) of the exhaust diffuser 50. The axial length $L_d$ can extend from an upstream end 63 of the diffuser shell 62 to a downstream end 65 of the diffuser shell 62 (see FIG. 4).

The inner boundary 58 can be defined by a center body, also referred to as a hub 68. The hub 68 can be generally cylindrical. The hub 68 can include an upstream end 70 and a downstream end 72. The terms "upstream" and "downstream" are intended to refer to the general position of these items relative to the direction of fluid flow through the exhaust diffuser section 50. The hub 68 can be connected to the diffuser shell 62 by a plurality of support struts 69, which can be arranged in circumferential alignment in a row.

The hub 68 can have an associated axial length $L_h$, radius $R_h$ and diameter $D_h$. An exhaust diffuser section configured according to aspects of the invention can have a shorter axial length compared to prior designs. In one embodiment, the axial length $L_h$ of the hub 68 can be about 2.2 to about 2.4 times the hub radius $R_h$. Because of its axial compactness, the hub 68 may only need to be supported by a single row of support struts 69. The axial length $L_h$ of the hub 68 can be from about 10 percent to about 12 percent of axial length $L_d$ of the exhaust diffuser 50.

The inner boundary 58 can also be defined by a tail cone 74. The tail cone can have an upstream end 76 and a downstream end 78. The tail cone 74 can have an associated axial length $L_{tc}$. The tail cone 74 can be attached to the downstream end 72 of the hub 68 in any suitable manner. The hub 68 and the tail cone 74 can be substantially concentric with the diffuser shell 62 and can share a common longitudinal axis 80.

Preferably, the tail cone 74 tapers from the upstream end 76 to the downstream end 78 in as short of an axial distance as possible. In one embodiment, the axial length $L_{tc}$ of the tail cone 74 can be from about 1 to about 2 times the hub radius $R_h$. More particularly, the axial length $L_{tc}$ of the tail cone 74 can be about 1.5 to about 2 times the hub radius $R_h$. Alternatively or in addition, the axial length $L_{tc}$ of the tail cone 74 can be about 70 to about 85 percent of the axial length $L_h$ of the hub 68.

According to aspects of the invention, the outer boundary 56 can be configured to direct at least a portion of the exhaust flow 54 toward the hub 68. To that end, outer boundary 56, such as diffuser shell 62, can be configured to achieve such a result. For instance, the outer boundary 56 can include a region 82 that extends generally radially inwardly toward the hub 68. The term "radially" and variants thereof are used herein to mean relative to the longitudinal axis 80. The region 82 can be formed in any suitable manner. For instance, the region 82 can be formed by one or more contours in the inner peripheral surface 64, by a protrusion extending from the inner peripheral surface 64, and/or by a separate piece attached to the inner peripheral surface 64 in any suitable manner. The region 82 can extend circumferentially or otherwise peripherally about the inner peripheral surface 64 of the diffuser shell 62. The outer boundary 56 can initially include an initial diverging region 84 that transitions into the radially inwardly extending region 82, which can later transition into a second diverging region 86.

The radially inwardly extending region 82 can have any suitable conformation. In one embodiment, the region 82 can have a generally semi-circular cross-sectional profile. Alternatively, the region 82 can have a generally semi-elliptical, generally parabolic, generally triangular, generally trapezoidal or generally semi-polygonal cross-sectional profile, just to name a few possibilities. The region 82 can have curved or rounded features or rounded edges to minimize flow disruptions.

The region 82 can have an associated beginning point 90. It will be understood that the beginning point 90 of the region 82 is the point at which the outer boundary 56 starts to move radially inward toward the inner boundary 58. In one embodiment, the region 82 can begin at a point that is substantially aligned with the downstream end 72 of the hub 68. Alternatively, the region 82 can begin at a point that is proximately upstream of the downstream end 72 of the hub 68. For instance, the region 82 can begin upstream of the downstream end 72 of the hub 68 within a distance of less than about one half of the hub diameter $D_h$ from the downstream end 72 of the hub 68.

The outer boundary 56 can continue to move radially inward toward the inner boundary 58 until a radially innermost point 88 of the region 82 is reached. In one embodiment, the radially innermost point 88 of the region 82 can be substantially aligned with the downstream end 78 of the tail cone 74. Alternatively, the radially innermost point 88 of the region 82 can be proximately upstream of the downstream end 78 of the tail cone 74. For instance, the radially innermost point 88 of the region 82 can be upstream of the downstream end 78 of the tail cone 74 within a distance of less than about one half of the length $L_{tc}$ of the tail cone 74. Alternatively or in addition to the above, the radially innermost point 88 of the region 82 can be downstream of the downstream end 72 of the hub 68 within a distance of less than about 1 to about 1.5 times the hub diameter $D_h$.

The reduction in diameter of the outer boundary 56 from the beginning 90 of the region 82 to the radially innermost point 88 of the region can be from about 10 to about 20 percent. In one embodiment, the diameter of the outer boundary 56 at the radially innermost point 88 of the region 82 can be substantially equal to the diameter of the outer boundary 56 at the exhaust diffuser inlet 52. In another embodiment, the diameter of the outer boundary 56 at the radially innermost point 88 of the region 82 can be less than the diameter of the outer boundary 56 at the exhaust diffuser inlet 52.

The overall axial length $L_r$ of the region 82 can be from about 2 to about 3 times the hub diameter $D_h$. More particularly, the overall axial length $L_r$ of the region 82 can be about 2.5 times the hub diameter $D_h$. The axial length $L_r$ of the region 82 is the axial distance between the beginning point 90 of the region 82, as described above, and the ending point 92 of the region 82, which can be the point at which the outer boundary 56 returns to the same diameter that it had at the beginning point 90 of the region 82.

The flow path 60 can have an associated flow area that varies over the axial length $L_d$ of the exhaust diffuser 50. FIG. 3 shows one example of how the total area of the exhaust diffuser flow path 60 can change along the axial length $L_d$ of the exhaust diffuser 50. More particularly, FIG. 3 graphically depicts the total flow area profile along the axial length of the exhaust diffuser, comparing the profile of one embodiment of an exhaust diffuser according to aspects of the invention, shown at 98, to the profile of a known exhaust diffuser design, shown at 96. FIG. 3 is presented as dimensionless because the actual dimensions will vary depending on the particular system and application and further because it is the relative ratios and/or percentages between various features and/or attributes of the components that are of significance.

Referring to profile 96, it can be seen that in a prior exhaust diffuser there was an initial expansion of flow area 96*a*. The total flow area dramatically increases in a region 96*b*, which coincides with the end of the inner boundary and remains at a constant total flow area 96*c* for some distance. This constant flow area 96*c* is indicative that the diameter of the outer boundary is held constant for a certain length in order to allow is wakes that form in the flow downstream of the end of the hub to be resolved before continuing the diffusion. The region of constant flow area 96*c* transitions into a region 96*d* in which the total flow area progressively increases until the downstream end 96*e* of the diffuser is reached.

In contrast, profile 98 of an exhaust diffuser configured according to aspects of the invention includes an initial region of expanding total flow area 98*a*, which transitions to a region 98*b* in which the flow area decreases. As noted above region 98*b* can correspond with the beginning of the radially inwardly extending region 82 of the outer boundary 56. Having a region of reduced flow area 98*b* at end of tail cone 74 and/or hub 68 can help to minimize wake formation in the flow. The region of reduced flow area 98*b* can transition to a region in which the flow area increases 98*c*. The reduced flow area region 98*b* can allow the outer boundary to have a more aggressive diffusion angle, which results in an appreciably greater total flow area. As shown in FIG. 3, the difference in flow area between the prior and proposed designs can be significant, particularly in the far downstream regions.

Because the outer boundary 56 of the flow path 60 moves radially inward in the region 82, the total flow area of the flow path 60 can be maintained or reduced at or near the downstream end 72 of the hub 68 or the tail cone 74. In one embodiment, the total flow area can be reduced by about 10 percent near the tail cone 74 before it begins to increase again. The exact amount and location of the flow area reduction can be tailored to the flow conditions prevalent in the particular application. For example, the diffuser inlet velocity distribution in the radial direction can have an impact on the tendency of the flow along the hub to separate, which will in turn affect the amount of flow path pinching necessary to maintain an acceptable level of hub flow.

Now that the individual components of the exhaust system according to aspects of the invention have been described, one manner in which the system can operate will be explained. During engine operation, gases 54 exiting the turbine section of the engine are passed through the exhaust diffuser 50. As the gases 54 encounter the region, the outer boundary 56 can direct at least a portion of the exhaust flow 54 toward the hub 68. The reduced total flow area can help to accelerate the exhaust flow on the tail cone 74 and can further reduce the likelihood of flow separation or dump losses at the end of the hub and increased pressure loss. Increasing flow velocity at the downstream end 72 of the hub 68 allows its flow path shape (tail-cone) to be tapered quickly to a small radius and truncated in a short distance without any significant flow separations.

With relatively lower hub losses, it may be possible to increase the expansion angle of the exhaust diffuser 50 downstream of the region 82. In one embodiment, the angle can be at about 6 degrees relative to the longitudinal axis 80. An increased diffuser angle can help to achieve a shorter overall length of the diffuser section $L_d$. For instance, it is estimated that the overall reduction in length $L_d$ of the exhaust diffuser 50 can be about 15-20% compared to prior designs.

FIG. 4 shows some of the potential differences in outer boundary profile, axial length and divergence angle between an exhaust diffuser configured according to aspects of the invention and known exhaust diffusers. It is noted that FIG. 4 is presented as dimensionless because the actual dimensions will vary depending on the particular system and application and further because it is the relative ratios and/or percentages between features or attributes of the components that are of significance. The outer boundary profile of a known exhaust diffuser is shown at 100; an outer boundary profile of an exhaust diffuser configured in accordance with aspects of the invention is shown at 102.

Both profiles 100, 102 begin with an initially diverging region 100*a*, 84, respectively. The initial region 100*a* of the known diffuser transitions to a region of a constant radius 100*b*, whereas, in contrast, the initial region 84 of a diffuser configured according to aspects of the invention transitions to the radially inwardly extending region 82. The region 82 transitions to the second diverging region 86, while, at this same point, the profile 100 of the known diffuser is still configured as a constant radius region 100*b*. Eventually, the constant radius region 100*b* of the known diffuser transitions to an expanding radius region 100*c*. However, it can be readily seen that the expansion angle of the exhaust diffuser according to aspects of the invention is more aggressive than the expansion angle of the known design, thereby achieving sufficient diffusion in a shorter distance so as to permit a short diffuser overall.

It will be appreciated that an exhaust diffuser system according to aspects of the invention can provide significant benefits. For instance, the power and efficiency of a gas turbine engine can be increased by raising the static pressure recovery of the exhaust diffuser. Further, the need for a long hub without incurring a pressure recovery penalty can be minimized, and possibly eliminated. In addition, the loss in pressure incurred by flow in an annular diffuser at the end of the hub can be reduced. In the end, an exhaust diffuser configured according to aspects of the invention can achieve the performance of a long hub system while enjoying the costs of a short hub system.

The foregoing description is provided in the context of one possible application for a system and method according to aspects of the invention. While the above description is made in the context of a gas turbine engine, it will be understood that the system according to aspects of the invention can be readily applied in almost any turbine engine system. Thus, it will of course be understood that the invention is not limited to the specific details described herein, which are given by way of example only, and that various modifications and alterations are possible within the scope of the invention as defined in the following claims.

What is claimed is:

1. An exhaust diffuser for a turbine engine comprising:

an inner boundary defined at least by a hub, the hub having an upstream end and a downstream end; and an outer boundary defined by a diffuser shell, the outer boundary being radially spaced from the inner boundary so that a flow path is defined therebetween, the outer boundary having a region in which the outer boundary extends radially inward toward the inner boundary, wherein the region begins at a point that is one of substantially aligned and proximately upstream of the downstream end of the hub and includes a point downstream of the hub.

2. The exhaust diffuser of claim 1 wherein the hub has an associated axial length from the upstream end to the downstream end and an associated radius, wherein the axial length is about 2.2 to about 2.4 times the hub radius.

3. The exhaust diffuser of claim 1 wherein the hub is supported by only a single row of support struts.

4. The exhaust diffuser of claim 1 wherein the hub has an associated axial length from the upstream end to the downstream end and the diffuser shell has an associated axial length from an upstream end to a downstream end, wherein the axial length of the hub is from about 10 percent to about 12 percent of axial length of the diffuser shell.

5. The exhaust diffuser of claim 1 further including a tail cone having an upstream end and a downstream end, wherein the upstream end of the tail cone is attached to the downstream end of the hub, and wherein the inner boundary is also defined by the tail cone.

6. The exhaust diffuser of claim 5 wherein the tail cone has an associated axial length and the hub has an associated radius, wherein the axial length of the tail cone is from about 1 to about 2 times the radius of the hub.

7. The exhaust diffuser of claim 5 wherein the tail cone has an associated axial length and the hub has an associated axial length, wherein the axial length of the tail cone is from about 70 to about 85 percent of the axial length of the hub.

8. The exhaust diffuser of claim 5 wherein the flow path has an associated total flow area that varies along the length of the exhaust diffuser, wherein the total flow area decreases in the area of the tail cone.

9. The exhaust diffuser of claim 8 wherein the total flow area of the flow path increases immediately downstream of the tail cone.

10. The exhaust diffuser of claim 5 wherein the region has a radially innermost point, wherein the radially innermost point is substantially aligned with the downstream end of the tail cone.

11. The exhaust diffuser of claim 5 wherein the region has a radially innermost point, wherein the radially innermost point is proximately upstream of the downstream end of the tail cone.

12. The exhaust diffuser of claim 1 wherein the region has a beginning point at an associated first diameter and a radially innermost point at an associated second diameter, wherein the second diameter is from about 80 to about 90 percent of the first diameter.

13. The exhaust diffuser of claim 1 wherein the region has a radially innermost point having an associated first diameter, wherein the outer boundary has an inlet at an associated second diameter, wherein the first diameter is substantially equal to the second diameter.

14. The exhaust diffuser of claim 1 wherein the region has a radially innermost point having an associated first diameter, wherein the outer boundary has an inlet at an associated second diameter, wherein the first diameter is less than the second diameter.

15. The exhaust diffuser of claim 1 wherein the region has an associated axial length and the hub has an associated diameter, wherein the axial length of the region is from about 2 to about 3 times the diameter of the hub.

16. The exhaust diffuser of claim 1 wherein the flow path has an associated total flow area that varies along the length of the exhaust diffuser, wherein the total flow area decreases in the area of the downstream end of the hub.

17. The exhaust diffuser of claim 1 wherein the exhaust diffuser has an associated axis, wherein the outer boundary extends at an angle to the axis immediately downstream of the region so as to form a diverging region.

18. The exhaust diffuser of claim 1 wherein the outer boundary has an initial diverging region transitioning into the radially inwardly extending region.

19. A method of exhaust diffusion in a turbine engine comprising the steps of:

providing a turbine engine having a turbine section and an exhaust diffuser section, the exhaust diffuser section including an inner boundary defined at least by a hub having an upstream end and a downstream end, the exhaust diffuser section further including an outer boundary radially spaced from the inner boundary so that a flow path is defined therebetween;

supplying turbine exhaust gas flow to the flow passage; and directing at least a portion of an outer boundary of the exhaust gas flow radially inward at a point downstream of the hub.

20. The method of claim 19 wherein the directing step is performed by the outer boundary in a region in which the outer boundary extends radially inward toward the inner boundary.

* * * * *